US009732503B1

(12) United States Patent
Erbach

(10) Patent No.: US 9,732,503 B1
(45) Date of Patent: Aug. 15, 2017

(54) CLEAN WATER CONSERVATION TANK FOR A TOILET

(71) Applicant: Frank Erbach, Winnipeg (CA)

(72) Inventor: Frank Erbach, Winnipeg (CA)

( * ) Notice: Subject to any disclaimer, the term of this patent is extended or adjusted under 35 U.S.C. 154(b) by 64 days.

(21) Appl. No.: 14/957,283

(22) Filed: Dec. 2, 2015

(51) Int. Cl.
*E03D 1/00* (2006.01)
*E03B 1/04* (2006.01)

(52) U.S. Cl.
CPC ..... *E03B 1/042* (2013.01); *E03B 2001/045* (2013.01)

(58) Field of Classification Search
CPC ..... E03B 1/042; E03B 1/04
USPC ..... 4/415
See application file for complete search history.

(56) References Cited

U.S. PATENT DOCUMENTS 4,371,992 A * 2/1983 Rivera ..... E03D 5/006 4/353
5,274,860 A 1/1994 Avila
5,285,537 A 2/1994 Hanks
5,341,529 A * 8/1994 Serrano ..... E03D 5/006 4/665
5,862,544 A 1/1999 Placencia
8,117,688 B2 * 2/2012 Chang ..... E03D 1/01 4/363
2009/0288246 A1 * 11/2009 Sanaghan, Jr. ..... E03D 1/003 4/415
2013/0061944 A1 * 3/2013 Tarantino ..... E03B 1/042 137/101.27

* cited by examiner

*Primary Examiner* — Huyen Le
(74) *Attorney, Agent, or Firm* — Stevenson IP, LLC

(57) ABSTRACT

A clean water conservation tank for a toilet providing a secondary clean water source to a toilet holding tank from a secondary holding tank mounted to a surface above and in fluid communication therewith. The secondary holding tank includes an outer container having an actuation body therein, a drain, a hollow puncture body attachable to the drain, and a portable internal container, or a substitute container such as a milk jug, removably disposed therein. The internal container has a one-way spring valve controlling the water level therein. Upon the engagement of the actuation body with the spring valve, the spring valve provides selective fluid communication between the internal container and the toilet holding tank. The puncture body, removably disposed within a cap inside the internal container, is used to puncture the substitute container for water flow through the drain and into the toilet holding tank.

5 Claims, 5 Drawing Sheets

CLEAN WATER CONSERVATION TANK FOR A TOILET

BACKGROUND OF THE INVENTION

Various types of water recapture devices are known in the prior art. However, what is needed is a clean water conservation tank for a toilet which provides a secondary source of water to a toilet holding tank.

FIELD OF THE INVENTION

The present invention relates to fresh water recapture devices, and more particularly, to a clean water conservation tank for a toilet.

SUMMARY OF THE INVENTION

The general purpose of the present clean water conservation tank for a toilet, described subsequently in greater detail, is to provide a clean water conservation tank for a toilet which has many novel features that result in a clean water conservation tank for a toilet which is not anticipated, rendered obvious, suggested, or even implied by prior art, either alone or in combination thereof.

To accomplish this, the present clean water conservation tank for a toilet is devised to provide a secondary source of clean water, such as from a kitchen faucet or a shower head while awaiting the flow of warm water, to a toilet holding tank disposed within the toilet. The device captures water, which would otherwise flow down the kitchen sink drain or a shower drain, for use to fill the toilet holding tank. The instant clean water conservation tank for a toilet includes a secondary holding tank mounted to a surface above and in fluid communication with the toilet water holding tank. The secondary holding tank includes an outer container. A vertically-oriented cylindrical spring valve actuation body is centrally disposed within a cavity of the outer container on a bottom side thereof. A drain is disposed in the bottom side of the outer container. A hollow puncture body, which has a sharp upper end, is removably attachable to the drain. A hose is in fluid communication with each of the drain and the hollow puncture body to provide fluid communication between the secondary holding tank and the toilet holding tank.

To capture the secondary source of clean water, the present device includes a portable internal container removably disposed within the outer container. A substitute container, such as a milk jug, can be alternately used to capture the secondary source of water. Each of the internal container and the substitute container has a handle. The internal container further includes a flap-covered lid disposed opposite a lower side thereof which is operated by a closure mechanism. A one-way spring valve, which controls the level of the water within the internal container, is centrally disposed within a housing on a lower side of the internal container. Upon the engagement of the spring valve actuation body with the spring valve, the spring valve is in a flow condition. The spring valve enables selective fluid communication between the internal container and each of the outer container and the toilet holding tank when the spring valve is in the flow condition.

A cap is disposed within the compartment on the internal container lower side. The puncture body is removably disposed within the cap for use to puncture the lower side of the substitute container. Upon removal of the cap from the puncture body, the puncture body is configured to puncture the lower side of the substitute container to transform the puncture body from a closed condition into a flow condition. Upon the opening of the water fill valve within the toilet holding tank and upon the spring valve being in the open condition, the amount of water contained within the internal container is released into the outer container and through the hose into the toilet holding tank. Similarly, upon the opening of the water fill valve within the toilet holding tank and upon the puncture body being in the flow condition, the amount of water contained within the substitute container is released through the hollow puncture body into the hose and then into the toilet holding tank. Support columns vertically disposed within the cavity on the bottom side support the support columns in a position above the bottom side.

Thus has been broadly outlined the more important features of the present clean water conservation tank for a toilet so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
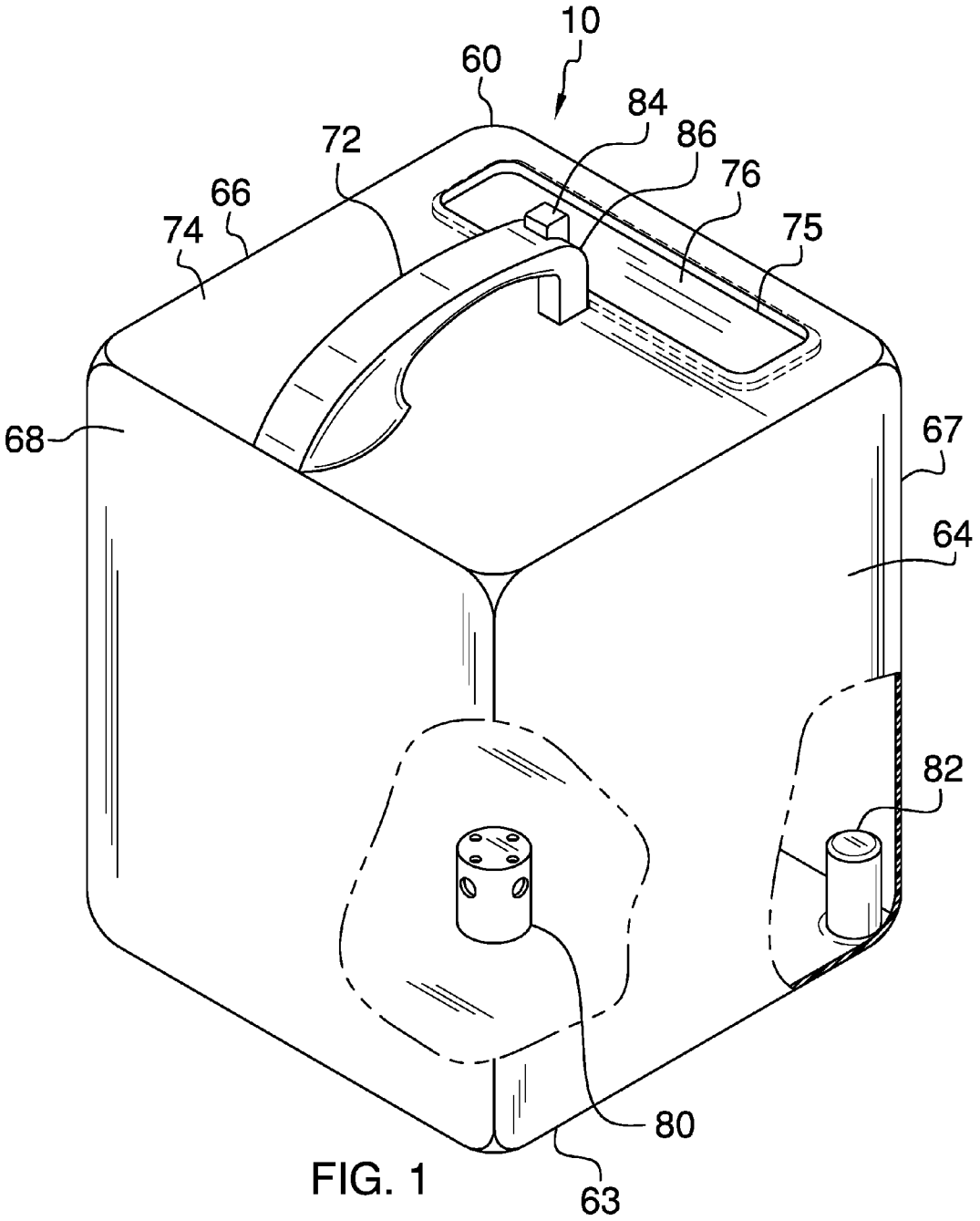
FIG. 1 is an isometric view of an internal container showing partial cutaway views of a one-way spring valve and a cap for a puncture tool disposed therein.
Figure 2:
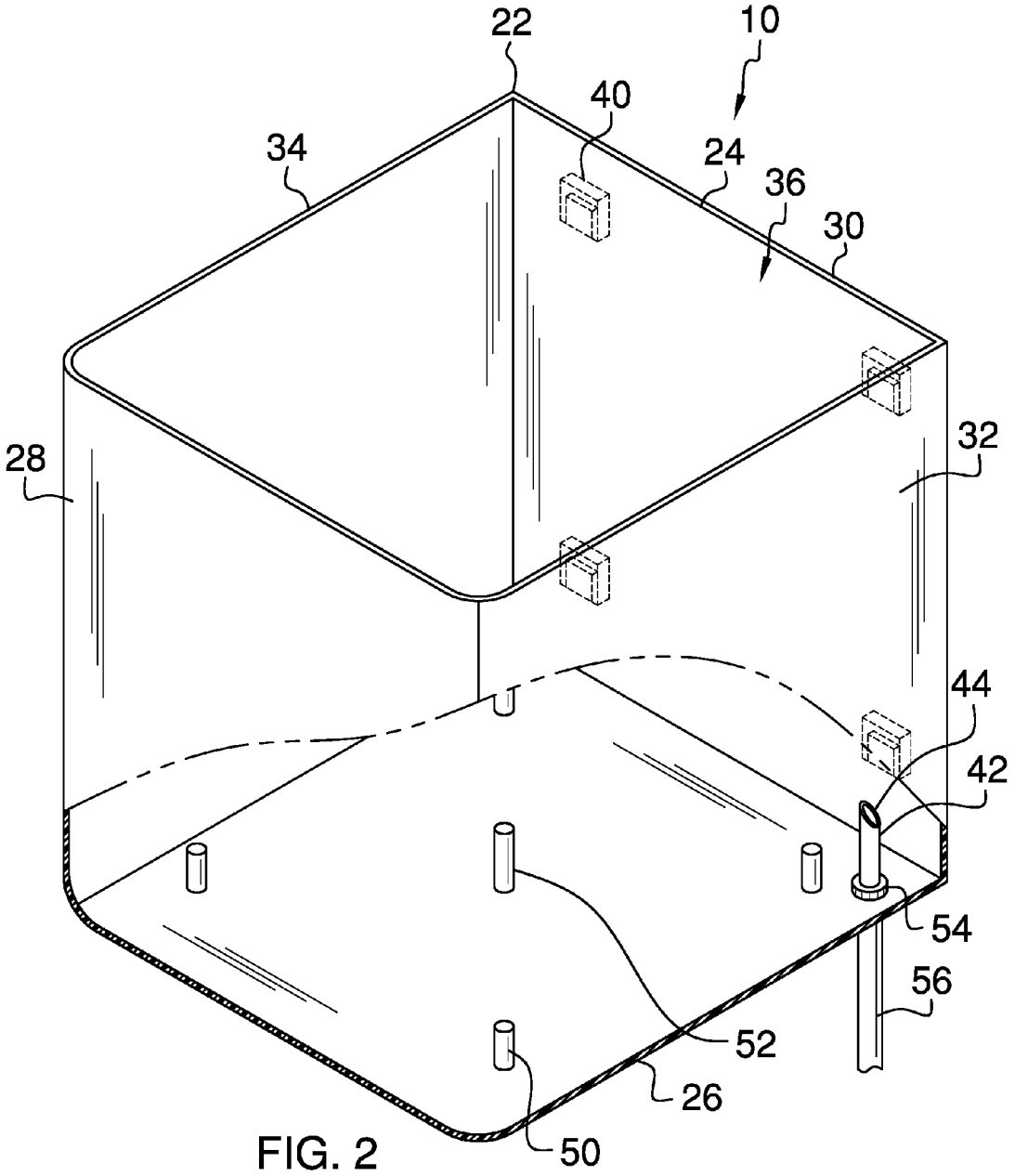
FIG. 2 is an isometric view of an outer container showing a partial cutaway view of the puncture tool, a hose, a plurality of support columns, and a plurality of mounting brackets therein.
Figure 3:
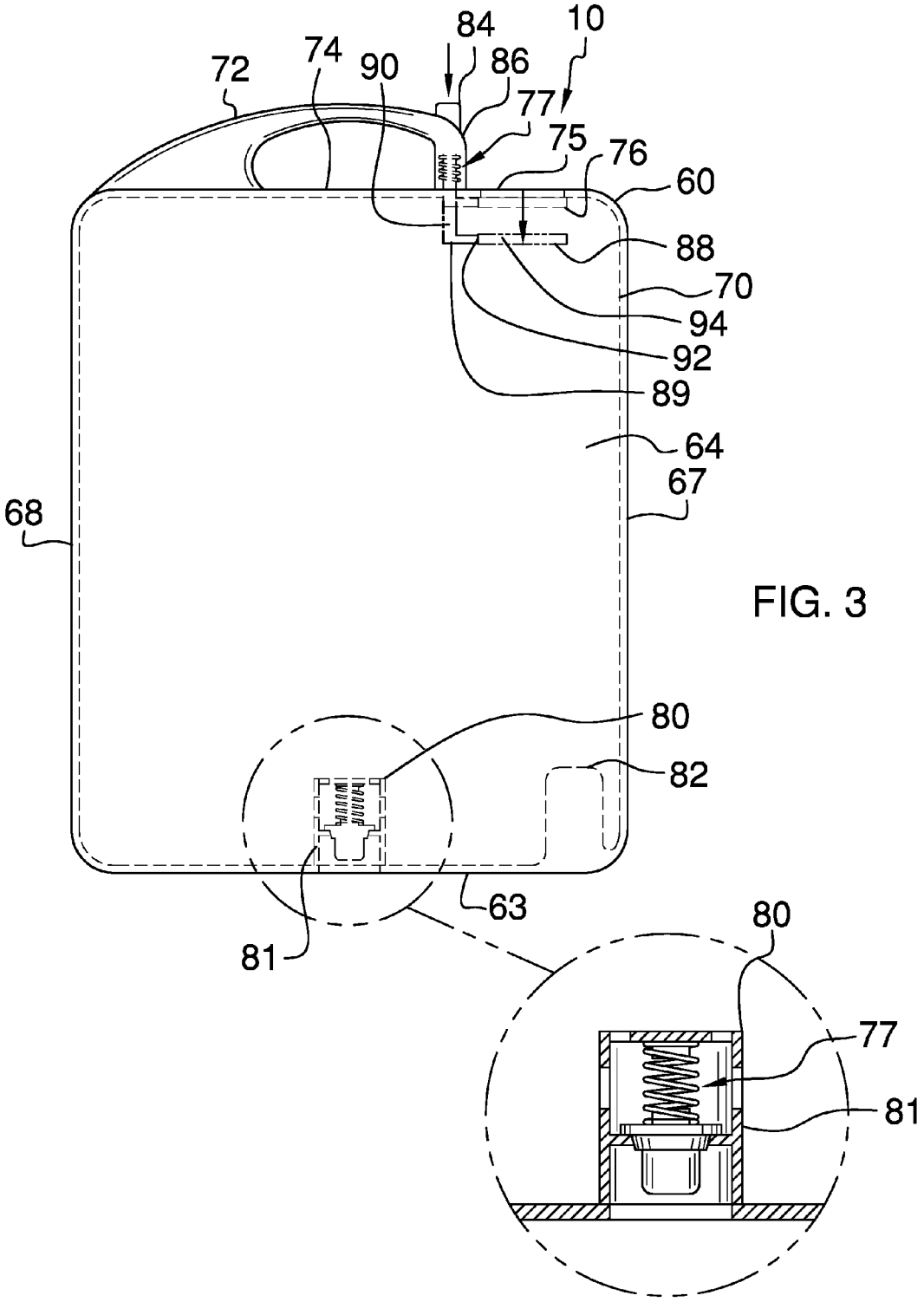
FIG. 3 is a side elevation view of the internal container including a detail view of the water release valve and a lid attachment mechanism.
Figure 4:
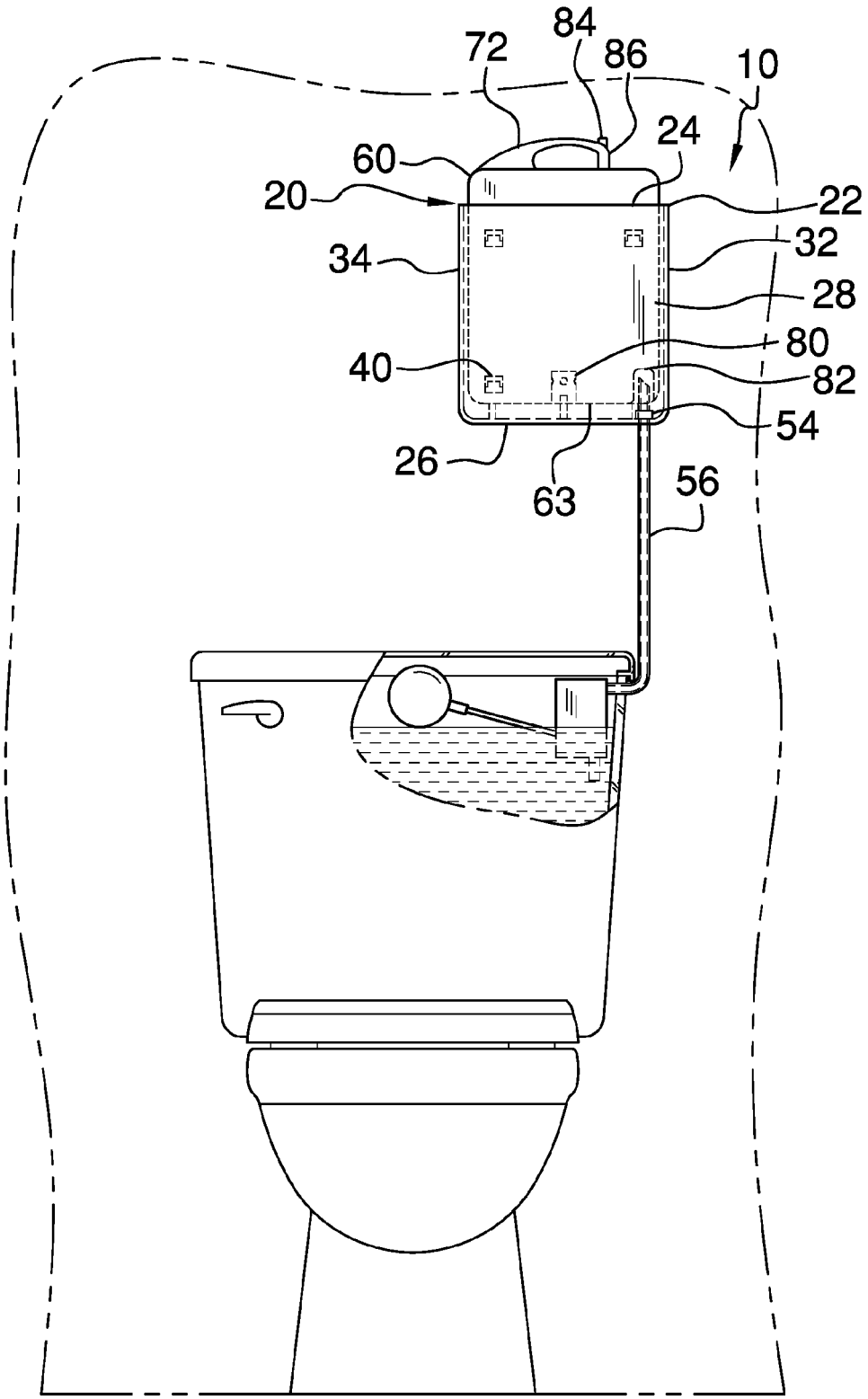
FIG. 4 is an in-use front elevation view with a partial cutaway showing a water fill valve and water shutoff float body within a toilet holding tank.
Figure 5:
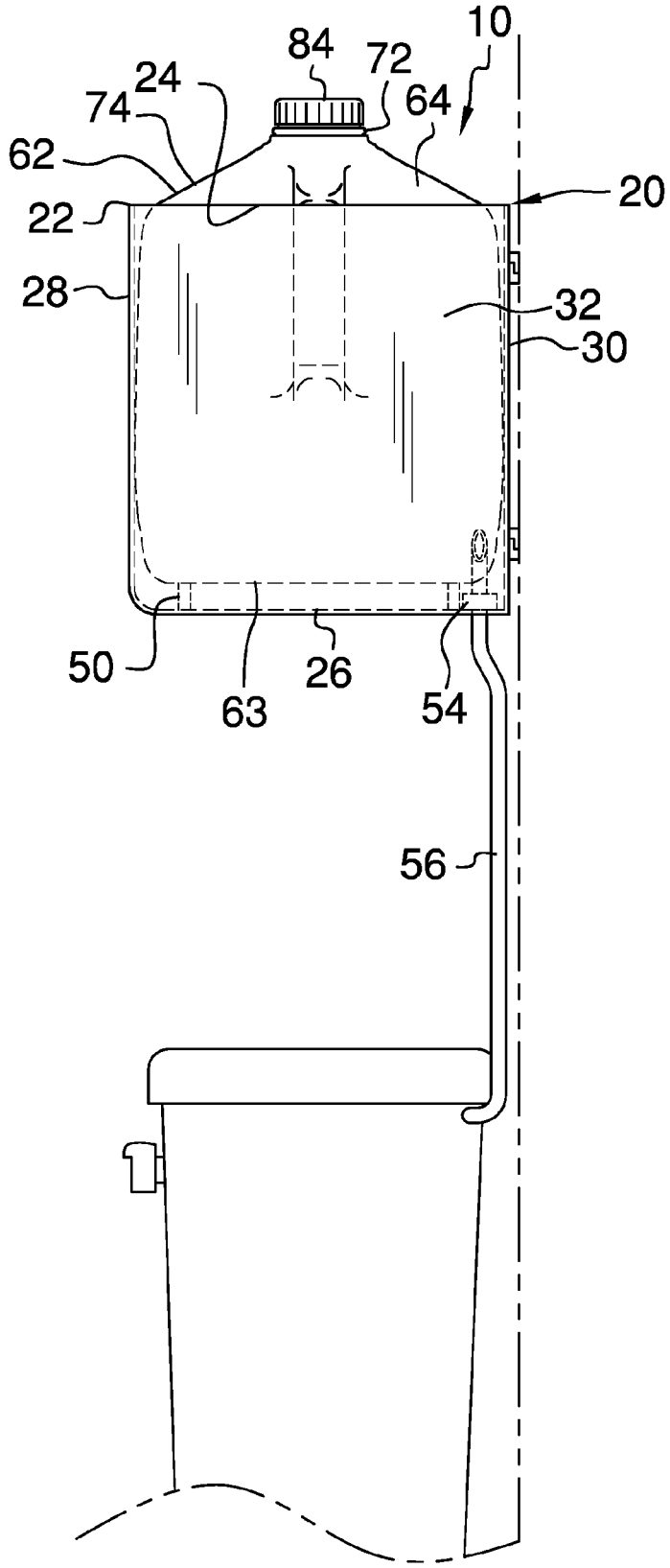
FIG. 5 is an in-use right side elevation view showing a substitute container disposed within the outer container.

With reference now to the drawings, and in particular FIGS. 1 through 5 thereof, an example of the instant clean water conservation tank for a toilet employing the principles and concepts of the present clean water conservation tank for a toilet and generally designated by the reference number 10 will be described.

Referring to FIGS. 1 through 5, the present clean water conservation tank for a toilet 10 is illustrated. The clean water conservation tank for a toilet 10 is devised to provide a secondary source of clean water to a toilet holding tank disposed within the toilet, which has at least a water shutoff float body and a water fill valve that opens and alternately closes the water fill valve. In order to conserve clean water, the secondary source of clean water can be water which would otherwise flow down a kitchen sink drain or a shower drain while waiting for the water to warm but, for the purposes of the present device, is captured to fill the toilet holding tank.

The present device 10 includes a secondary holding tank 20 mounted to a surface above the toilet water holding tank. The secondary holding tank 20 is in fluid communication with the toilet holding tank. The secondary holding tank 20 includes an outer container 22. The outer container 22 has an open top side 24, a bottom side 26, a front side 28, a rear side 30, a right side 32, a left side 34, and a cavity 36 defined by the bottom side 26, the front side 28, the rear side 30, the right side 32, and the left side 34. A plurality of mounting brackets 40 is disposed on the rear side 30 of the secondary holding tank 20 to mount the secondary holding tank 20 to the surface. A plurality of support columns 50 is vertically disposed within the cavity 36 on the bottom side 26. In addition, a vertically-oriented cylindrical spring valve actuation body 52 is centrally disposed within the cavity 36 on the bottom side 26. A drain 54 is disposed in the bottom side 26 of the outer container 22. A hollow puncture body 42 is removably attachable to the drain 54. The puncture body 42 has a sharp upper end 44. A hose 56 is in fluid communication with each of the drain 54 and the hollow puncture body 42 to provide fluid communication between the secondary holding tank 20 and the toilet holding tank.

To capture the secondary source of clean water, the present device includes a portable internal container 60, which is fillable with water, removably disposed within the outer container 22. An alternate substitute container 62, such as a milk jug, can be alternately used to capture the secondary source of water. Each of the internal container 60 and the substitute container 62 has a lower side 63, a forward side 64, a rearward side 66, a first side 67, a second side 68, and a compartment 70 defined by the lower side 63, the forward side 64, the rearward side 65, the first side 66, and the second side 67. Each of the internal container 60 and the substitute container 62 also has a handle 72. The internal container 60 further includes a lid 74 disposed opposite the lower side 63, an opening 75 disposed within the lid 74, and an openable flap 76 disposed along the entire opening 75. A closure mechanism 77, which is in operational communication with the flap 76, opens and alternately closes the flap 76. The internal container 60 has approximately a same shape and dimensions as the outer container 22.

A one-way spring valve 80, which controls the level of the water within the internal container 60, is centrally disposed within a housing 81 within the compartment 70 on the internal container 60 lower side 63. Upon the engagement of the spring valve actuation body 52 with the spring valve 80, the spring valve 80 is in a flow condition. The spring valve 80 enables selective fluid communication between the internal container 60 and each of the outer container 22 and the toilet holding tank when the spring valve 80 is in the flow condition.

A cap 82 is disposed within the compartment 70 on the internal container 60 lower side 63. The puncture body 42 is removably disposed within the cap 82 for use to puncture the lower side 63 of the substitute container 62. Upon removal of the cap 82 from the puncture body 42, the puncture body 42 is configured to puncture the lower side 63 of the substitute container 62 to transform the puncture body 42 from a closed condition into a flow condition. Upon the opening of the water fill valve within the toilet holding tank and upon the spring valve 80 being in the open condition, the amount of water contained within the internal container 60 is released into the outer container 22 and through the hose 56 into the toilet holding tank. Similarly, upon the opening of the water fill valve within the toilet holding tank and upon the puncture body 42 being in the flow condition, the amount of water contained within the substitute container 62 is released through the hollow puncture body 42 into the hose 56 and then into the toilet holding tank. The internal container 60 and alternately the substitute container 62 are supported atop the support columns 50.

The closure mechanism 77, discussed hereinabove, includes a spring-loaded actuation button 84 disposed on a proximal end 86 of the handle 72. The flap 76 comprises a base 88 and an arm 89. The base 88 has the same shape and dimensions as the opening 75. The arm 89 has an L-shaped cross-section, has an upper end 90 attached to the actuation button 84 and a lower end 92 attached to an internal end 94 of the base 88. When the actuation button 84 is actuated, the flap 76 is transformed from a closed position within the opening 75 to an open position away from the opening 75.

What is claimed is:

1. A clean water conservation tank for a toilet having a a toilet holding tank disposed therein and having at least a water shutoff float body and a water fill valve, wherein the water shutoff float body opens and alternately closes the water fill valve, the clean water conservation tank comprising:

a secondary holding tank mounted to a surface above the toilet water holding tank, the secondary holding tank in fluid communication with the toilet holding tank, the secondary holding tank comprising:

an outer container having an open top side, a bottom side, a front side, a rear side, a right side, a left side, and a cavity defined by the bottom side, the front side, the rear side, the right side, and the left side;

a plurality of support columns vertically disposed within the cavity on the bottom side;

a vertically-oriented cylindrical spring valve actuation body centrally disposed within the cavity on the bottom side;

a drain disposed in the bottom side of the outer container;

a hollow puncture body removably attachable to the drain;

a hose in fluid communication with each of the drain and the water fill valve;

a portable internal container removably disposed within the outer container, the internal container being configured to store and alternately release an amount of water therein and alternately therefrom, the internal container comprising:

a lower side, a forward side, a rearward side, a first side, a second side, and a compartment defined by the lower side, the forward side, the rearward side, the first side, and the second side;

a handle;

a lid disposed opposite the lower side;

an opening disposed within the lid;

an openable flap disposed along the entire opening;

a closure mechanism in operational communication with the flap, wherein the closure mechanism opens and alternately closes the flap;

wherein the internal container has approximately a same shape and dimensions as the outer container;

a one-way spring valve centrally disposed within a housing within the compartment on the internal container lower side, wherein upon the engagement of the spring valve actuation body with the spring valve, the spring valve is in a flow condition;

wherein the spring valve is configured to enable selective fluid communication between the internal container and the toilet holding tank when the spring valve is in the flow condition;

a cap disposed within the compartment on the internal container lower side, wherein the puncture body is removably disposed within the cap;

wherein upon the opening of the water fill valve within the toilet holding tank and upon the spring valve being in the open condition, the amount of water contained within the internal container is released into the outer container and through the hose into the toilet holding tank;

wherein the internal container is supported atop the support columns.

2. The clean water conservation tank of claim 1 wherein the closure mechanism comprises:

a spring-loaded actuation button disposed on a proximal end of the handle;

wherein the flap comprises a base and an arm, the base having the same shape and dimensions as the opening, wherein the arm has an L-shaped cross-section, has an upper end attached to the actuation button and a lower end attached to an internal end of the base;

wherein when the actuation button is actuated, the flap is transformed from a closed position within the opening to an open position away from the opening.

3. The clean water conservation tank of claim 1 further comprising a substitute container alternately removably disposed within the outer container, the substitute container being configured to store and alternately release an amount of water therein and alternately therefrom, the substitute container comprising:

a lower side, a forward side, a rearward side, a first side, a second side, and a compartment defined by the lower side, the forward side, the rearward side, the first side, and the second side;

wherein upon removal of the cap from the puncture body, the puncture body is configured to puncture the lower side of the substitute container to transform the puncture body from a closed condition into a flow condition;

wherein upon the opening of the water fill valve within the toilet holding tank and upon the puncture body being in the flow condition, the amount of water contained within the substitute container is released through the puncture body into hose and then into the toilet holding tank; and wherein the substitute container is supported atop the support columns.

4. The clean water conservation tank of claim 1 further comprising a plurality of mounting brackets disposed on the rear side of the secondary holding tank.

5. A clean water conservation tank for a toilet having a a toilet holding tank disposed therein and having at least a water shutoff float body and a water fill valve, wherein the water shutoff float body opens and alternately closes the water fill valve, the clean water conservation tank comprising:

a secondary holding tank mounted to a surface above the toilet water holding tank, the secondary holding tank in fluid communication with the toilet holding tank, the secondary holding tank comprising:

an outer container having an open top side, a bottom side, a front side, a rear side, a right side, a left side, and a cavity defined by the bottom side, the front side, the rear side, the right side, and the left side;

a plurality of support columns vertically disposed within the cavity on the bottom side;

a vertically-oriented cylindrical spring valve actuation body centrally disposed within the cavity on the bottom side;

a drain disposed in the bottom side of the outer container;

a hollow puncture body removably attachable to the drain, the puncture body having a sharp upper end;

a hose in fluid communication with each of the drain and the water fill valve;

a plurality of mounting brackets disposed on the rear side of the secondary holding tank;

a portable internal container and alternately a substitute container removably disposed within the outer container, the internal container and alternately the substitute container being configured to store and alternately release an amount of water therein and alternately therefrom, each of the internal container and the substitute container comprising:

a lower side, a forward side, a rearward side, a first side, a second side, and a compartment defined by the lower side, the forward side, the rearward side, the first side, and the second side;

a handle;

the internal container further comprising:

a lid disposed opposite the lower side;

an opening disposed within the lid;

an openable flap disposed along the entire opening;

a closure mechanism in operational communication with the flap, wherein the closure mechanism opens and alternately closes the flap, wherein the closure mechanism comprises:

a spring-loaded actuation button disposed on a proximal end of the handle;

wherein the flap comprises a base and an arm, the base having the same shape and dimensions as the opening, wherein the arm has an L-shaped cross-section, has an upper end attached to the actuation button and a lower end attached to an internal end of the base;

wherein when the actuation button is actuated, the flap is transformed from a closed position within the opening to an open position away from the opening;

wherein the internal container has approximately a same shape and dimensions as the outer container;

a one-way spring valve centrally disposed within a housing within the compartment on the internal container lower side, wherein upon the engagement of the spring valve actuation body with the spring, the spring valve is in a flow condition;

wherein the spring valve is configured to enable selective fluid communication between the internal container and the toilet holding tank when the spring valve is in the flow condition;

a cap disposed within the compartment on the internal container lower side, wherein the puncture body is removably disposed within the cap;

wherein upon removal of the cap from the puncture body, the puncture body is configured to puncture the lower side of the substitute container to transform the puncture body from a closed condition into a flow condition;

wherein upon the opening of the water fill valve within the toilet holding tank and upon the spring valve being in the open condition, the amount of water contained within the internal container is released into the outer container and through the hose into the toilet holding tank;

wherein upon the opening of the water fill valve within the toilet holding tank and upon the puncture body being in the flow condition, the amount of water contained within the substitute container is released through the puncture body into hose and then into the toilet holding tank; and wherein the internal container and alternately the substitute container are supported atop the support columns.

* * * * *